US005479379A

United States Patent [19]

Tsuchiya et al.

[11] Patent Number: 5,479,379

[45] Date of Patent: Dec. 26, 1995

[54] ALARM CLOCK

[75] Inventors: Hidetaka Tsuchiya; Haruhiko Higuchi, both of Tanashi, Japan

[73] Assignee: Citizen Watch Co., Ltd., Tokyo, Japan

[21] Appl. No.: 351,245

[22] PCT Filed: Nov. 10, 1994

[86] PCT No.: PCT/JP93/01641

§ 371 Date: Dec. 7, 1994

§ 102(e) Date: Dec. 7, 1994

[51] Int. Cl.[6] ..... G04B 27/08

[52] U.S. Cl. ..... 368/74; 368/80; 368/261; 368/250; 368/223

[58] Field of Search ..... 368/281, 282, 368/232, 223, 294–296, 72–80, 243, 244, 249, 250, 259, 260, 228, 261

[56] References Cited

U.S. PATENT DOCUMENTS 4,470,707 9/1984 Chambon et al. ..... 368/74
4,652,140 3/1987 Nakazawa ..... 368/74
5,289,452 2/1994 Sakamoto et al. ..... 368/73

FOREIGN PATENT DOCUMENTS 58-153192 9/1983 Japan .
60-236086 11/1985 Japan .
2-77680 3/1990 Japan .

*Primary Examiner*—Bernard Roskoski
*Attorney, Agent, or Firm*—Kanesaka & Takeuchi

[57] ABSTRACT

The alarm clock is formed of time indicating hands (3), alarm hands (4), and an alarm setting device (202, 204, 205, and 207); wherein the alarm setting device is provided with an alarm section (200) which works to stop the movement of alarm hands when the alarm setting device is in the alarm-set condition, and works to move the alarm hands in synchronous motion with the time indicating hands when the alarm setting device is in the non-alarm-set condition. This structure allows the wearer to instantly distinguish the alarm-set condition from the non-alarm-set condition.

12 Claims, 12 Drawing Sheets

Fig. 6
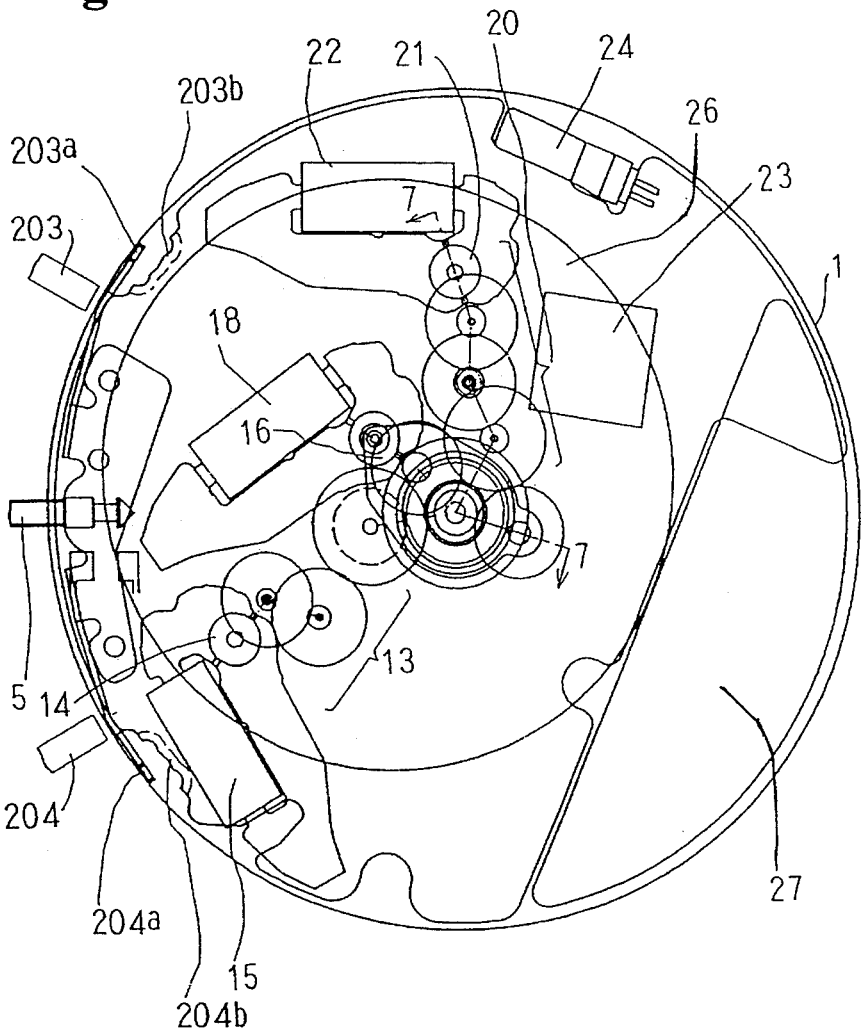
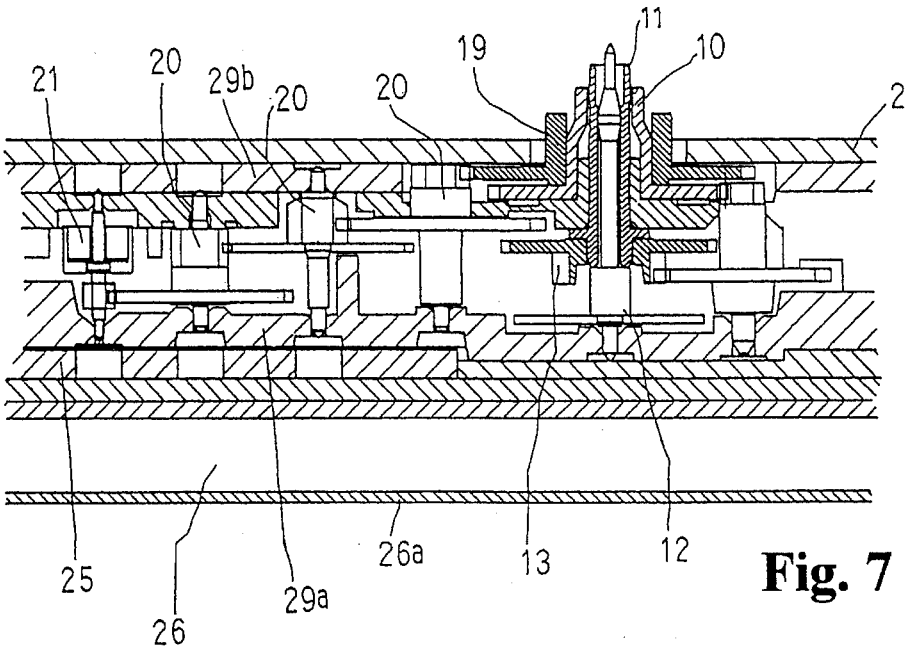
Fig. 7

ALARM CLOCK

BACKGROUND OF THE INVENTION

1. Field of the Invention

The present invention relates to an alarm clock, and, in particular, to such an alarm clock that the alarm-set condition and non-alarm-set condition can be readily distinguished; the alarm-set time can be distinctly indicated when the clock is in alarm-set condition; and the alarm hands do not obstruct the display when the clock is in non-alarm-set condition.

2. Description of the Background Art

Alarm clocks provided with an alarm function which gives a time sounding signal at the time preset by an alarm hand have been used as analog electronic timepieces. A number of proposals have been made on the method of letting the user easily and certainly know whether such alarm clocks are in alarm-set condition or in non-alarm-set condition.

For example, Japanese Patent Publication (Kokoku) No. 51237/1983 proposes a wristwatch with a display window provided on the dial which selectively displays day and date or the information as to whether it is in the alarm-setting condition (ON or OFF). Japanese Patent Publication (Kokoku) No. 7078/1991 proposes an analog electronic timepiece provided with hands which are designed to have double functions; a function as an ordinary time indicating hand and another function as an alarm time indicating hand. To bring the timepiece to the alarm-set condition, the hands are moved to designate the alarming time in advance and remain there until the alarming time comes, whereupon the watch sounds the time signal and the hands return to normal movement.

However, in the timepiece proposed in Japanese Patent Publication (Kokoku) No. 51237/1983, the alarm-set condition must be indicated on a display window by operating the winding stem, a button, or the like to show whether the timepiece is in the alarm-set condition or not. This imposes troublesome load to the wearer and, in addition, carries a structural problem that needs a specific fixture for displaying the alarm-set condition.

On the other hand, although the timepiece proposed in Japanese Patent Publication (Kokoku) No. 7078/1991 does not need to be equipped with additional alarm hands separately, there remains a problem that the wearer cannot know the current time when the timepiece is in the alarm-set condition, because the time indicating hands function as the alarm hands when the timepiece is in the alarm-set condition, indicating the alarm time apart from current time indication.

Accordingly, an object of the present invention is to provide an alarm clock, overcoming the aforementioned problems of conventional alarm clocks, whose alarm-set condition and non-alarm-set condition can be distinguished instantly without exercising any actions and without providing any additional display fixture for indicating the alarm-set condition, and which is capable of showing current time even when the timepiece is in the alarm-set condition.

Another object of the present invention is to provide an alarm clock in which the alarm hands do not obstruct the display when the clock is in the non-alarm-set condition, by allowing the alarm hands to have the function of time indicating hands by making them to be moved in synchronous motion with the time indicating hands, or by making the alarm hands to be moved together overlapping the time indicating hands.

DISCLOSURE OF THE INVENTION

The alarm clock of the present invention has time indicating hands, alarm hands, and an alarm setting means. The alarm setting means is provided with an alarm section which stops the movement of the alarm hands when said alarm setting means is in the alarm-set condition, and moves the alarm hands when said alarm setting means is in the non-alarm-set condition. This structure allows the wearer to distinguish instantly and clearly whether the clock is in the alarm-set condition or in non-alarm-set condition, without exerting any action.

Furthermore, the alarm clock of the present invention is arranged such that the time indicating hands and the alarm hands are installed on the same axis, so that the alarm hands are moved in synchronous motion with the time indicating hands when the alarm is not set. This construction makes it possible that the alarm hands in this alarm clock does not obstruct the display when the clock is in the non-alarm-set condition.

Further, in the alarm clock of the present invention, the alarm hands are installed as subsidiary hands on an axis different from the axis for the time indicating hands in order to indicate a time different from the time indicated by the time indicating hands, and further these alarm hands are moved in synchronous motion with the time indicating hands. This construction enables the alarm clock to be used as a world clock, for example, by providing the alarm hands with a function of indicating the time in foreign countries.

BRIEF DESCRIPTION OF THE DRAWINGS

The drawings illustrate the alarm clock of the present invention, in which FIGS. 1(*a*) and 1(*b*) are external front views of a first embodiment with alarm hands provided as subsidiary hands, wherein the clock is in the non-alarm-set condition in FIG. 1(*a*) and in the alarm-set condition in FIG. 1(*b*).

FIG. 6 is a plan view showing the wheel train construction of the second embodiment presented in FIG. 2.

FIG. 7 is a cross-sectional view along the line 7—7 in FIG. 6.

BEST MODE FOR CARRYING OUT THE INVENTION

Preferred embodiments of the alarm clock of the present invention will now be discussed in detail with reference to the accompanying drawings, which are in no way limitative of the scope of the present invention.

Figure 1A:
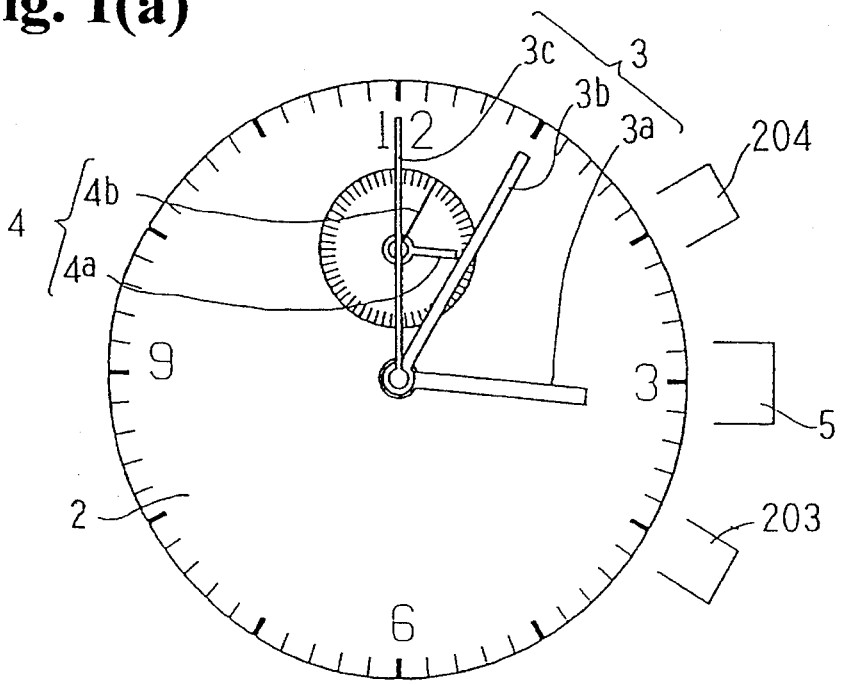
Figure 1B:
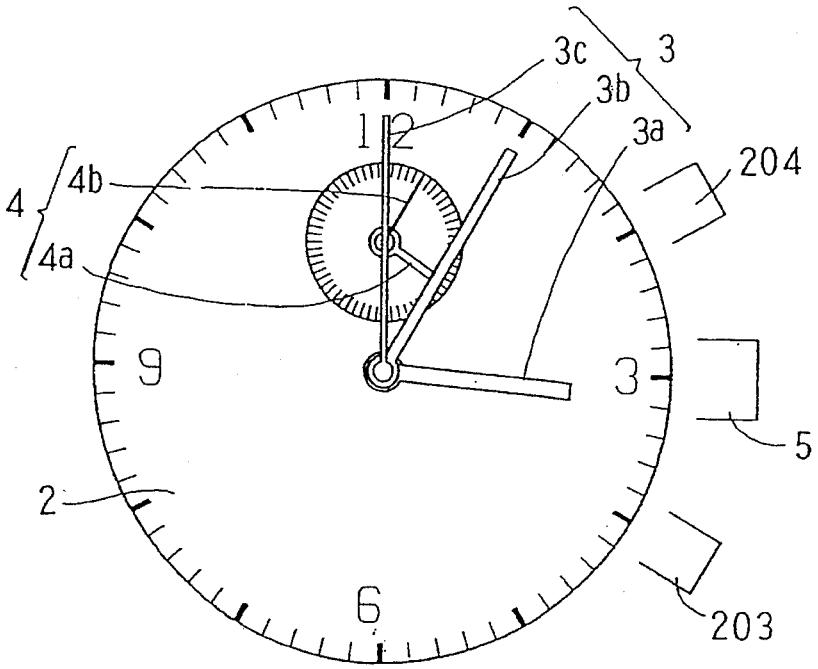
Figure 2A:
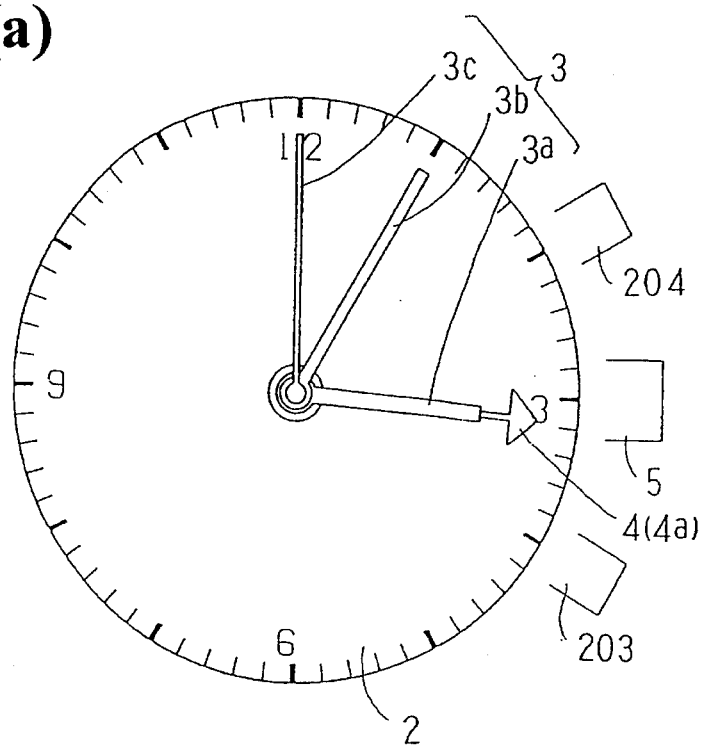
FIGS. 2(*a*) and 2(*b*) are external front views of a second embodiment, in which alarm hands are installed on the same axis with the time indicating hands to display as if the alarm hand is the time indicating hands, wherein the clock is in the non-alarm-set condition in FIG. 2(*a*) and in the alarm-set condition in FIG. 2(*b*).
Figure 2B:
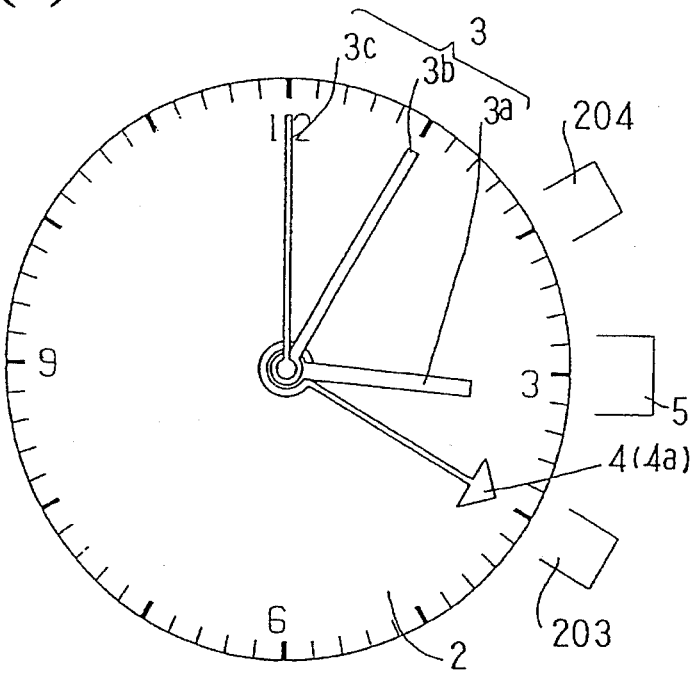

The alarm clock of the present invention is applied to electronic analog timepieces, and there are types wherein the alarm hands are displayed as subsidiary hands as shown in FIGS. 1(*a*) and 1(*b*), displayed on the same axis with time indicating hands as shown in FIGS. 2(*a*) and 2(*b*), and the like.

The alarm clock of the first embodiment presented in FIG. 1 comprises time indicating hands 3, which include an hour hand 3*a*, a minute hand 3*b* and a second hand 3*c*, positioned around the center of a dial 2 enclosed in a case 1, as well as alarm hands 4, which include an hour hand 4*a* and a minute hand 4*b*, for indicating the alarm-set time, positioned at the upper center part of the dial 2.

Figure 3:
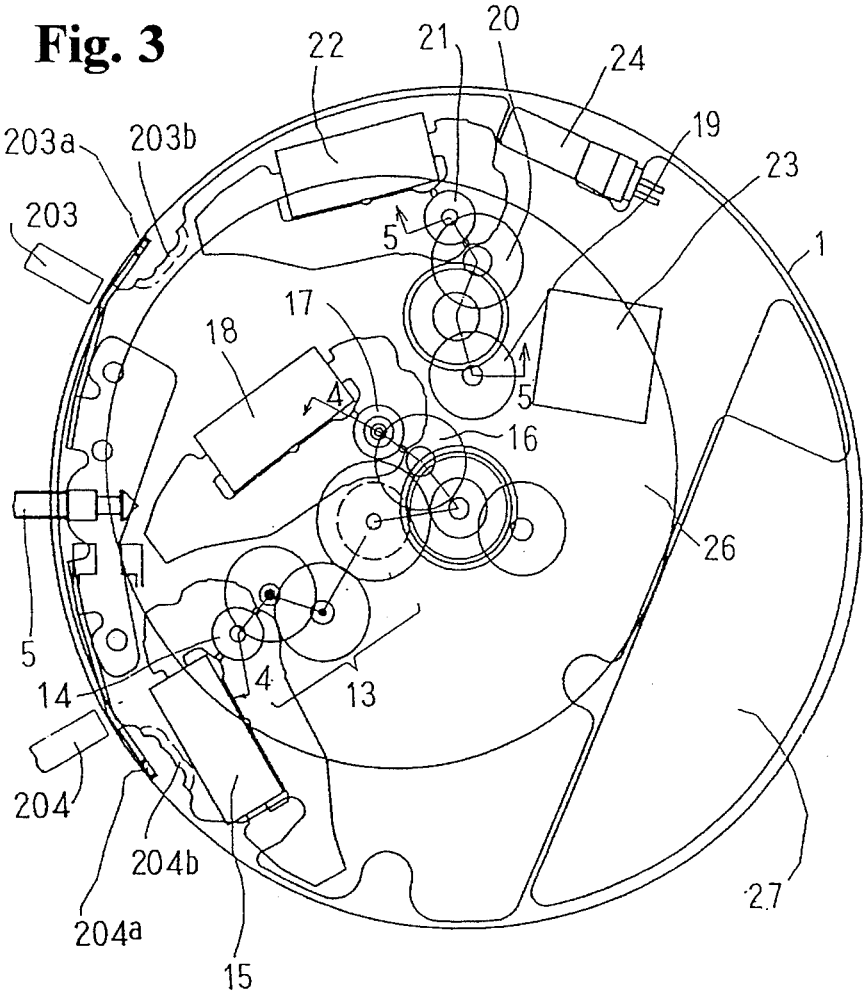
FIG. 3 is a plan view showing the wheel train construction of the first embodiment presented in FIG. 1.
Figure 5:
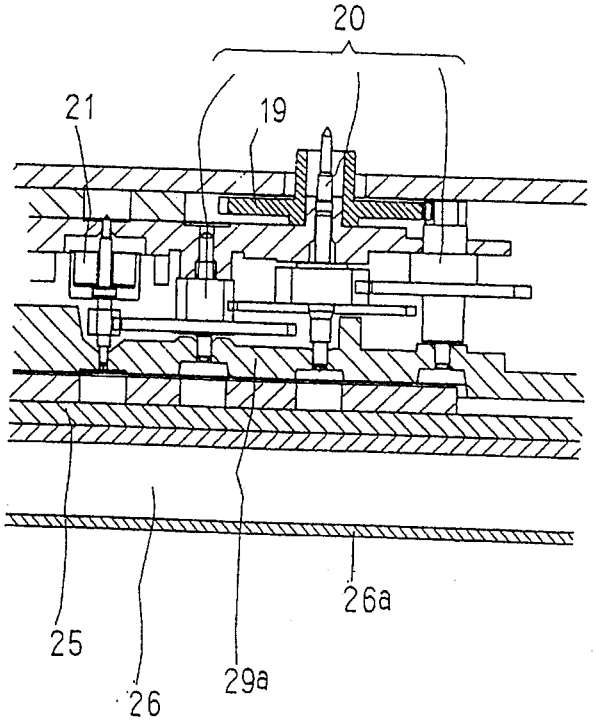
FIG. 5 is a cross-sectional view along the line 5—5 in FIG. 3.
Figure 4:
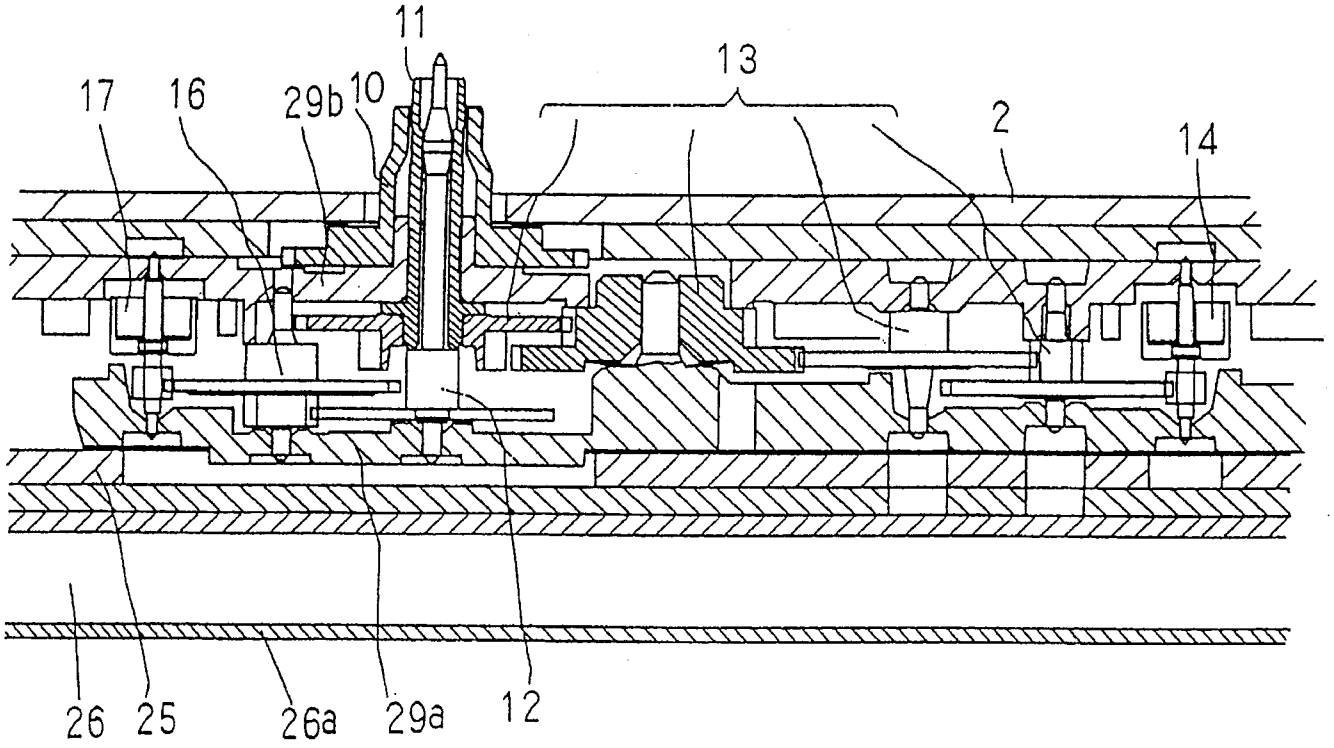
FIG. 4 is a cross-sectional view along the line 4—4 in FIG. 3.

FIG. 3 is a plan view showing the construction of the wheel trains in the alarm clock in the first embodiment, which is provided with the alarm hands 4 displayed as subsidiary hands. FIG. 4 is a cross-sectional view along the line 4—4 in FIG. 3, while FIG. 5 is a cross-sectional view along the line 5—5 in FIG. 3.

In these drawings, conventional wheels including an hour wheel 10 for the hour hand 3*a*, a minute wheel 11 for the minute hand 3*b*, and a fourth wheel 12 for the second hand 3*c* are installed inside the case 1 coaxially at the center thereof, while the hour wheel 10 and the minute wheel 11 are linked to an hour motor 15, which includes an hour rotor 14, via a wheel train 13 consisting of a center wheel, a third wheel, a fourth wheel, and a fifth wheel for indicating the hour and minute. Likewise, a second wheel 12 is linked to a second motor 18, which includes a second rotor 17, via a second intermediate wheel 16.

In addition, an alarm wheel 19 for displaying the alarm hands 4 as subsidiary hands is installed at the upper center (at 12 o'clock position) of the case. This alarm wheel 19 is linked to an alarm motor 22, which includes an alarm rotor 21, via a wheel train 20 consisting of an alarm second wheel, an alarm minute wheel, and an alarm fourth wheel.

Besides the above-mentioned wheel trains and motors, a circuit substrate 25 mounting a regulating IC 23 and a crystal oscillator 24, a battery 26, a buzzer driving unit 27, and the like are enclosed in the case 1.

Each wheel of the wheel trains is supported by a train wheel bridge 29*a* and a base plate 29*b*, whereas the battery 26 is held by a battery clamp plate 26*a*.

The hands of an alarm clock, which include the time indicating hands 3*a*, 3*b*, and 3*c*, and the alarm hands 4*a* and 4*b*, are driven by these elements of construction.

The alarm clock of the second embodiment shown in FIG. 2 is provided with an hour hand 3*a*, a minute hand 3*b* and a second hand 3*c*, together with alarm hands 4 for indicating the alarm-set time; all being installed coaxially around the center of a dial 2 which is enclosed in the case 1.

FIG. 6 is a plan view showing the construction of the wheel train in the second embodiment, and FIG. 7 is the cross-sectional view along the line 7—7 in FIG. 6.

The alarm clock of this embodiment is provided with an hour wheel 10, a minute wheel 11, a second wheel 12, and an alarm wheel 19, all being installed coaxially. The hour wheel 10 and the minute wheel 11 are linked to the hour rotor 14 and the hour motor 15 via the hour wheel train 13, whereas the second wheel 12 is linked to the second motor 18, which includes the second rotor, via the second intermediate wheel 16.

On the other hand, the alarm wheel 19 is linked to the alarm motor 22, which includes the alarm rotor 21, via the alarm wheel train 20 consisting of an alarm second wheel, an alarm third wheel, and an alarm fourth wheel, in a similar fashion as in the first embodiment, although the disposition of these elements are different. Also, the circuit substrate 25, the battery 26, the buzzer driving unit 27, etc., are installed in a similar fashion as in the first embodiment.

Specific embodiments of the electric driving circuit which is one of the features of the present invention will now be discussed in detail.

Figure 8:
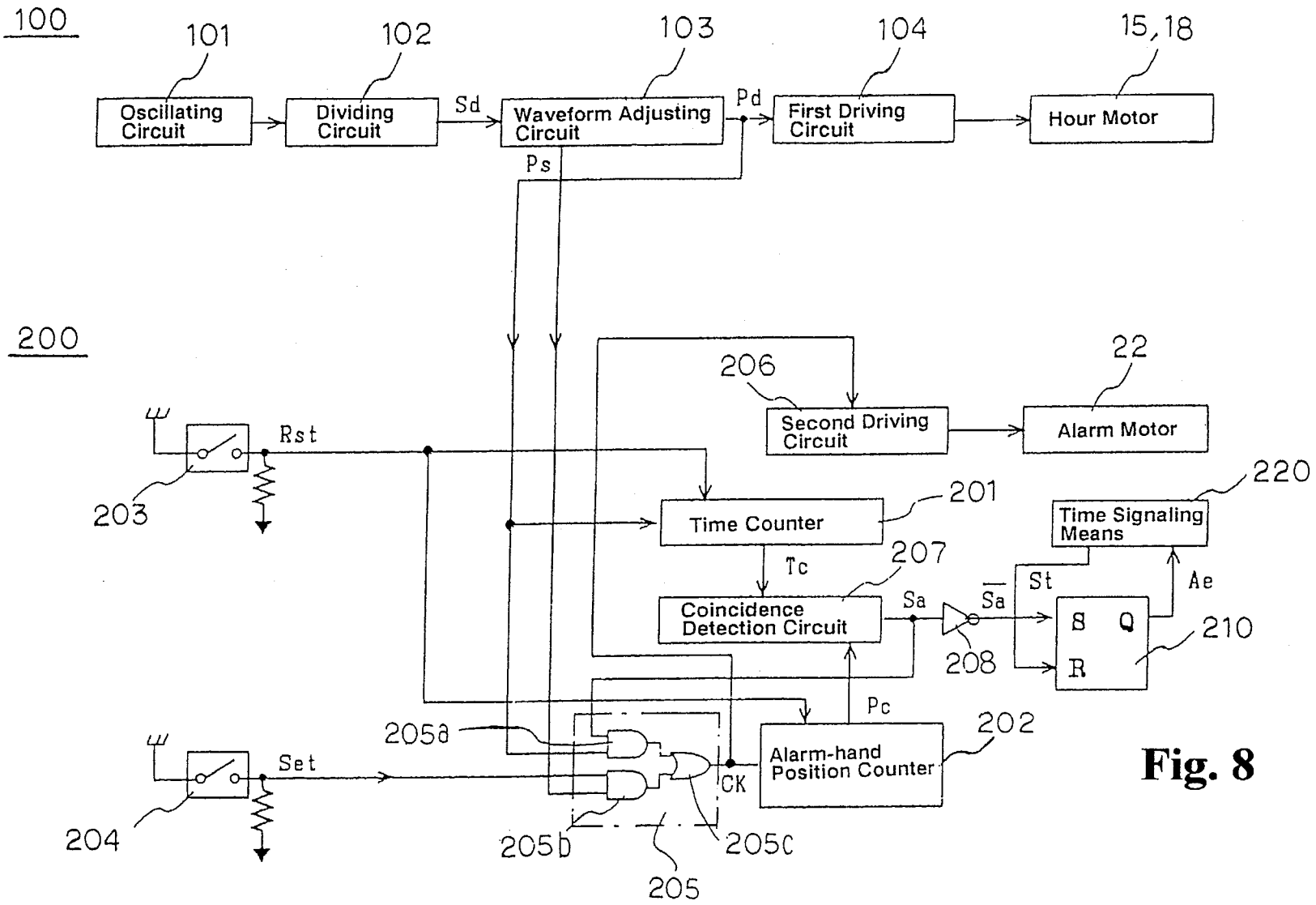
FIG. 8 is a block diagram illustrating the construction of the electric circuit in the first embodiment of the alarm clock presented in FIGS. 1 and 2.

FIG. 8 is a block diagram showing a first embodiment of the electric driving circuit. The electric circuit presented in this drawing comprises a timer section 100 provided for normal movements of the time indicating hands and an alarm section 200 provided for the regulation of the alarm hands and signal sounding.

The timer section 100 comprises an oscillating circuit 101 which oscillates the vibration of a crystal oscillator 24 as a standard timer signal; a dividing circuit 102 which divides the standard timer signal (Sd) from said oscillating circuit 101; a waveform adjusting circuit 103 which adjusts the waveform of said divided signal from said dividing circuit 102 into a pulse signal Pd for driving said hour motor 15 and said second motor 18; and a first driving circuit 104 which drives said hour motor 15 and said second motor 18 based on the time-counting pulse signal from said waveform adjusting circuit 103.

The alarm section 200 is provided with a time counter 201 which memorizes the current time by receiving and counting the pulse signal Pd from said waveform adjusting circuit 103; an alarm-hand position counter 202 which memorizes the position of the alarm hands 4; an initializing switch 203 which makes the positions of the time indicating hands 3 and the alarm hands 4 to coincide with the positions memorized by said time counter 201 and said alarm-hand position counter 202, respectively; an alarm setting switch 204 which brings the clock into alarm-set condition by manipulating the alarm hands 4; an alarm-hand regulating section 205 which is provided with two AND gates 205*a* and 205*b* and an OR gate 205*c*; a second driving circuit 206 which drives the alarm motor 22 for moving the alarm hands; a coincidence detection circuit 207 which compares said time counter 201 and said alarm-hand position counter 202; an inverter (NOT gate) 208 which inverts the output of said coincidence detection circuit 207; a time-signal regulating section 210 comprising a set-and-reset flip-flop; and a time signaling means 220 which transmits sound, vibration or light for the time-signal based on the signal Ae from said time-signal regulating section 210.

The initialize switch 203 and the alarm setting switch 204 are installed on the side of case 1 such that they can be pushed. When they are pushed, switch spring 203*a* and 204*a* provided in the case are pushed and made to come contact respectively with a switch pattern 203*b* and 204*b* to bring them into the ON status.

The alarm setting switch 204, alarm-hand position counter 202, alarm-hand regulating section 205, coincidence detection circuit 207, etc., collectively constitute the alarm-set means.

Actions of the driving electric circuit of the first embodiment as constructed in this manner will now be explained referring to the time chart given in FIG. 9.

Synchronizing Action of the Time Indicating Hands with Alarm Hands

When a timepiece is moved initially, as in the case after battery change, an initializing procedure must be taken to electrically coincide the positions of the time indicating hands 3 and the alarm hands 4.

Upon completion of the battery change, the electronic timepiece starts movement as each circuit in the timer section 100 begins to work and drives the time motor 15 and second motor 18, and, at the same time, the waveform adjusting circuit 103 transmits a fastforwarding signal Ps to the second AND gate 205*b* and a time-count pulse signal Pd to the first AND gate 205*a*, of the alarm-hand regulating section 205.

In this condition, however, the relationship between the positions of the time indicating hands 3 and the time counter 201, and the relationship between the positions of the alarm hands and the alarm-hand position counter 202 are not fixed. An initializing procedure from this condition begins with forwarding the time indicating hands to the standard position at 12:00:00 by manipulating a known adjusting forward means (omitted from the drawing) for the time indicating motors 15 and 18.

Then, when the alarm setting switch 204 is set "ON", the second AND gate 205*b* is brought to "ON", causing the fast-forwarding pulse signal Ps to be sent to the alarm-hand position counter 202 and to the second driving circuit 206 as an alarm-hand driving signal CK via the second AND gate 205*b*. As a result, the contents of the alarm-hand position counter 202 and the alarm hands 4 are brought into the forwarding condition, the alarm hands 4 can be forwarded and set at the standard position of 12:00:00.

At this time, although mechanical positioning of the time indicating hands 3 and the alarm hands 4 has been achieved, the contents of the time counter 201 and the alarm-hand position counter 202 do not coincide with the corresponding hands. Then, the initializing switch 203 is set "ON" to send a signal to the time counter 201 and the alarm-hand position counter 202 for resetting these counters 201 and 202, thereby causing the contents of said time counter 201 and the alarm-hand position counter 202 to coincide with the positions of time indicating hands 3 and alarm hands 4, respectively. The time indicating hands 3 and the alarm hands 4 are synchronized both electrically and mechanically by this procedure.

Normal Movement Condition

Normal movement condition refers to the condition where the alarm is not set and the time indicating hands 3 and the alarm hands 4 move in a synchronous motion.

In this case, the output Sa from the coincidence detection circuit 207 is kept at "H" condition, since the contents of the time counter 201 and the alarm-hand position counter 202 are consistent each other. Under this condition, the first AND gate 205*a* in the alarm-hand regulating section 205 permits the time-counting pulse signal Pd from the waveform adjusting circuit 103 to pass therethrough. The time-counting pulse signal Pd passed through the alarm-hand regulating section 205 is sent to the alarm-hand position counter 202 and to the second driving circuit 206 as the alarm-hand driving signal CK.

Accordingly, the time motors 15 and 18, and the alarm motor 22 are driven synchronously by the time-counting pulse signal Pd. The time-counting pulse signal Pd is also supplied to the time counter 201 and the alarm-hand position counter to bring the both counters to be electrically synchronized.

This condition where the time indicating hands 3 and the alarm hands 4 are driven in a synchronous motion is the non-alarm-set condition.

In the case where the time indicating hands 3 and the alarm hands 4 move synchronously as mentioned above, if the time indicating hands 3 and the alarm hands 4 are installed coaxially as in the second embodiment and the time indicating hands 3 and the alarm hands 4 are overlapped one on the other, the alarm hands do not obstruct the display because the hands 3 and 4 move together as they are overlapped.

Additionally, in the first or second embodiment of the alarm clock of the present invention, if the alarm hands 4 are set at local time in any foreign country, the clock can be used as a world clock since the alarm hands 4 are kept for indicating the foreign time.

Alarm Setting Action

Figure 9:
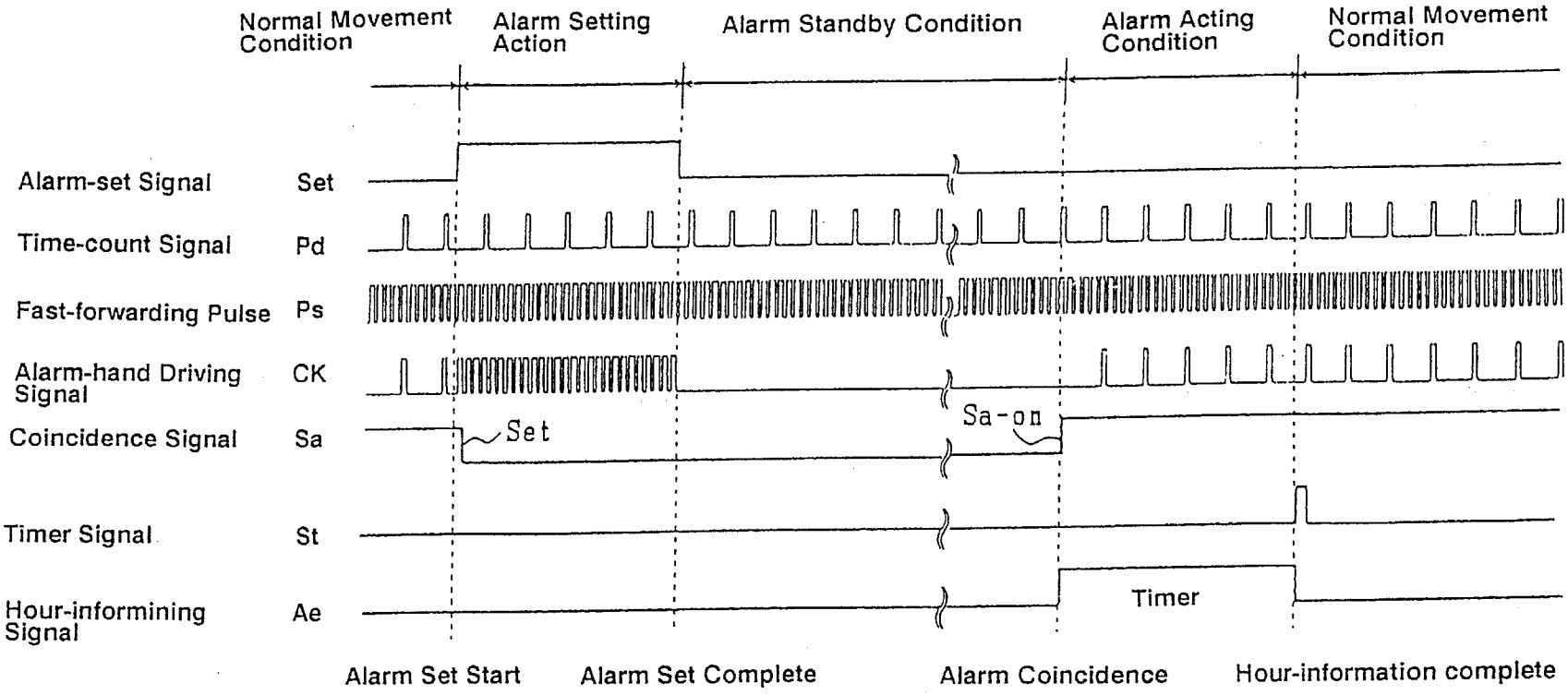
FIG. 9 is a time chart showing wave-form signals in various parts of the electric circuit in FIG. 8.

To set the alarm during the normal movement condition, the setting signal should be kept at "H" condition, as shown in FIG. 9, by turning the alarm-set switch 204 "ON". Under this condition the second AND gate 205*b* in the alarm-hand regulating section 205 allows the fast-forwarding pulse signal Ps from the waveform adjusting circuit 103 to pass through. The fast-forwarding pulse signal Ps passed through the alarm-hand regulating section 205 is sent to the alarm-hand position counter 202 and the second driving circuit 206 as the alarm-hand driving signal CK, as shown in FIG. 9.

If the alarm-hand position counter 202 receives said fast-forwarding pulse signal Ps (first pulse) for setting the alarm, the output Sa from the coincidence detection circuit 207 falls down to "L" (the set condition in FIG. 9) because the contents of the time counter 201 and the alarm-hand position counter 202 become inconsistent. This prevents the time-counting pulse signal Pd from passing through the first AND gate 205*a* and stops the actions of the alarm-hand position counter 202 and the second driving circuit 206 by the time-counting pulse signal Pd.

On the other hand, because said fast-forwarding pulse signal Ps is kept to be sent to the alarm-hand position counter 202 and the second driving circuit 206 as the alarm-hand driving signal CK, the alarm hands 4 and the content of the alarm-hand position counter 202 are forwarded.

When the alarm setting switch 204 is turned "OFF" at the moment when the alarm hand 4 reaches the target alarm-set time, the second AND gate 205*b* prevents the fast-forward pulse signal Ps to pass through, because the set signal falls down to "L". In this manner, the supply of the fast-forward pulse signal Ps as the alarm-hand driving signal CK to the alarm-hand position counter 202 and the second driving circuit 206 is stopped, as shown in FIG. 9, and thus the alarm-set is completed.

Alarm Standby Condition

Under the condition where the alarm-set is completed by turning the alarm-set switch 204 OFF, the output Sa from aforementioned coincidence detection circuit 207 is kept at "L", as shown in FIG. 9. Therefore, the time-counting pulse signal Pd is prevented from passing through the first AND gate 205*a* of said alarm-hand regulating section 205, so that the alarm-hand driving signal CK is not supplied to the alarm-hand position counter 202 and the second driving circuit 206.

For this reason, the alarm hands 4 are kept standing at the alarm-set time, and this standstill status of the alarm hands 4 indicates that the timepiece is in the alarm-set condition. Under this condition, actions of the timepiece are limited to the movement of the time indicating hands 3 and the counting of the pulse signal Pd by the time counter 201.

Alarm Acting Condition

As mentioned above, the time-counting pulse signal Pd is counted by the time counter 201, and when the content of the time counter 201 (current time) eventually becomes to coincide with the memorized content of the alarm-hand position counter 202 (alarm-set time), the output Sa from the coincidence detection circuit 207 changes to "H" (Sa-on condition in FIG. 9.) The output Sa from the inverter gate 208 thus turns from "H" to and is input to the time-signal regulating section 210.

The time-signal regulating section 210 transmits the time signal Ae with "H" state as shown in FIG. 9, to the time signaling means 220 to cause it to sound the alarm to notice the alarm-set time. The alarm sounding is brought to cease by resetting the time-signal regulating section 210, as shown in FIG. 9, when the timer signal St for stopping the alarm sound is sent from the timer installed in the time signaling means 220.

On the other hand, when the output Sa from said coincidence detection circuit 207 becomes to "H" condition, again the time-counting pulse signal Pd is supplied to the alarm-hand position counter 202 and to the second driving circuit 206 as the alarm-hand driving signal CK via the first AND gate 205*a* of the alarm-hand regulating section 205. The time indicating hands 3 and alarm hands 4 are then driven in a synchronous motion with the time counter 201 and the alarm-hand position counter 202, bringing the timepiece to a normal movement condition.

A sequential actions of the electric driving circuit in the first embodiment of the present invention is completed in this manner.

Figure 10:
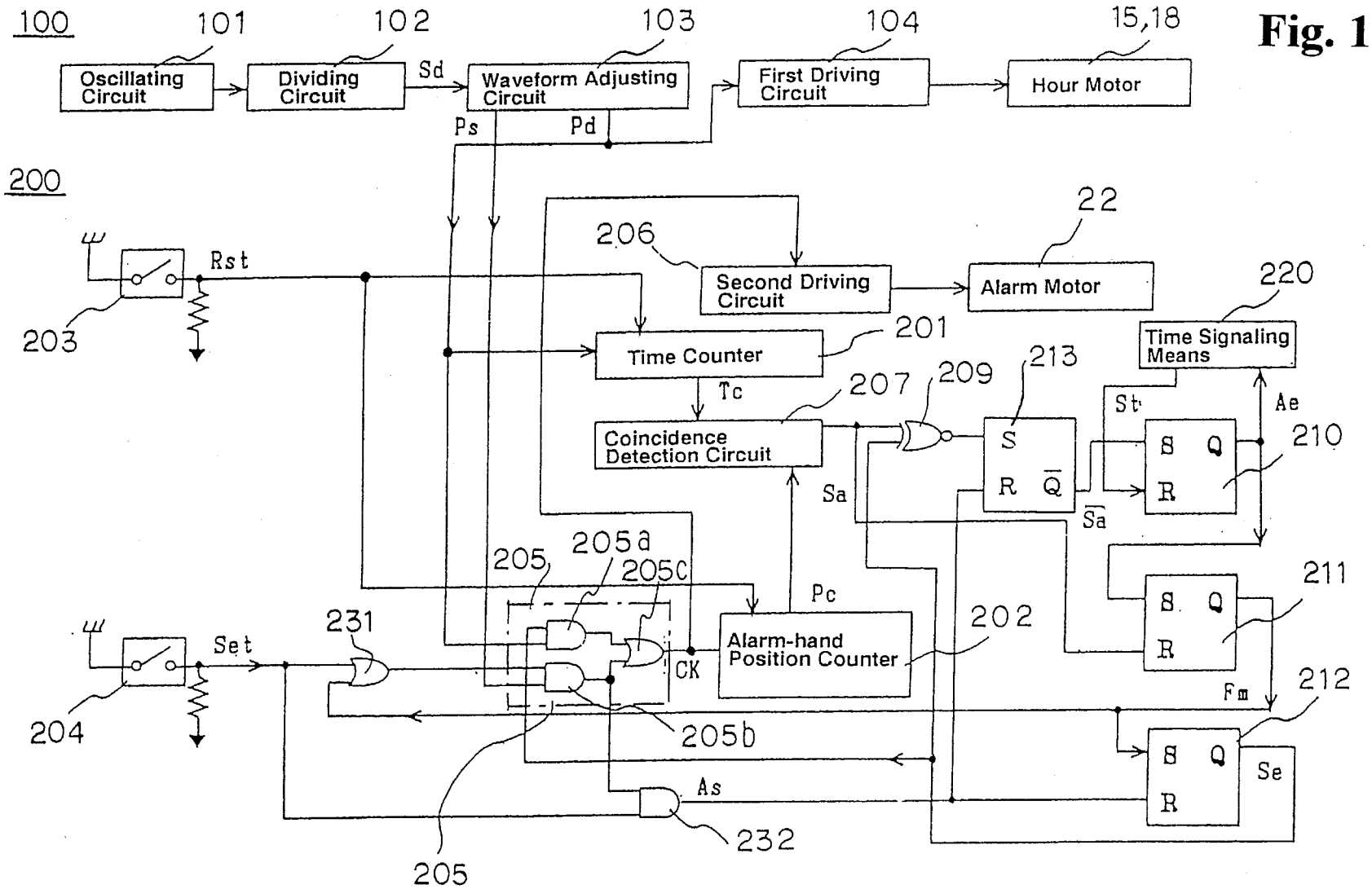
FIG. 10 is a block diagram illustrating the construction of the electric circuit in the second embodiment of the alarm clock in FIGS. 1 and 2.

FIG. 10 is a diagram showing the construction of the electric driving circuit employed in the second embodiment. This second embodiment is an improvement over the aforementioned first embodiment, and is designed to avoid the battery voltage drop by inhibiting simultaneous driving of the time-signaling means 220 and the alarm motor 22 by stopping the movement of the alarm hands during the time-signal sounding.

Figure 11:
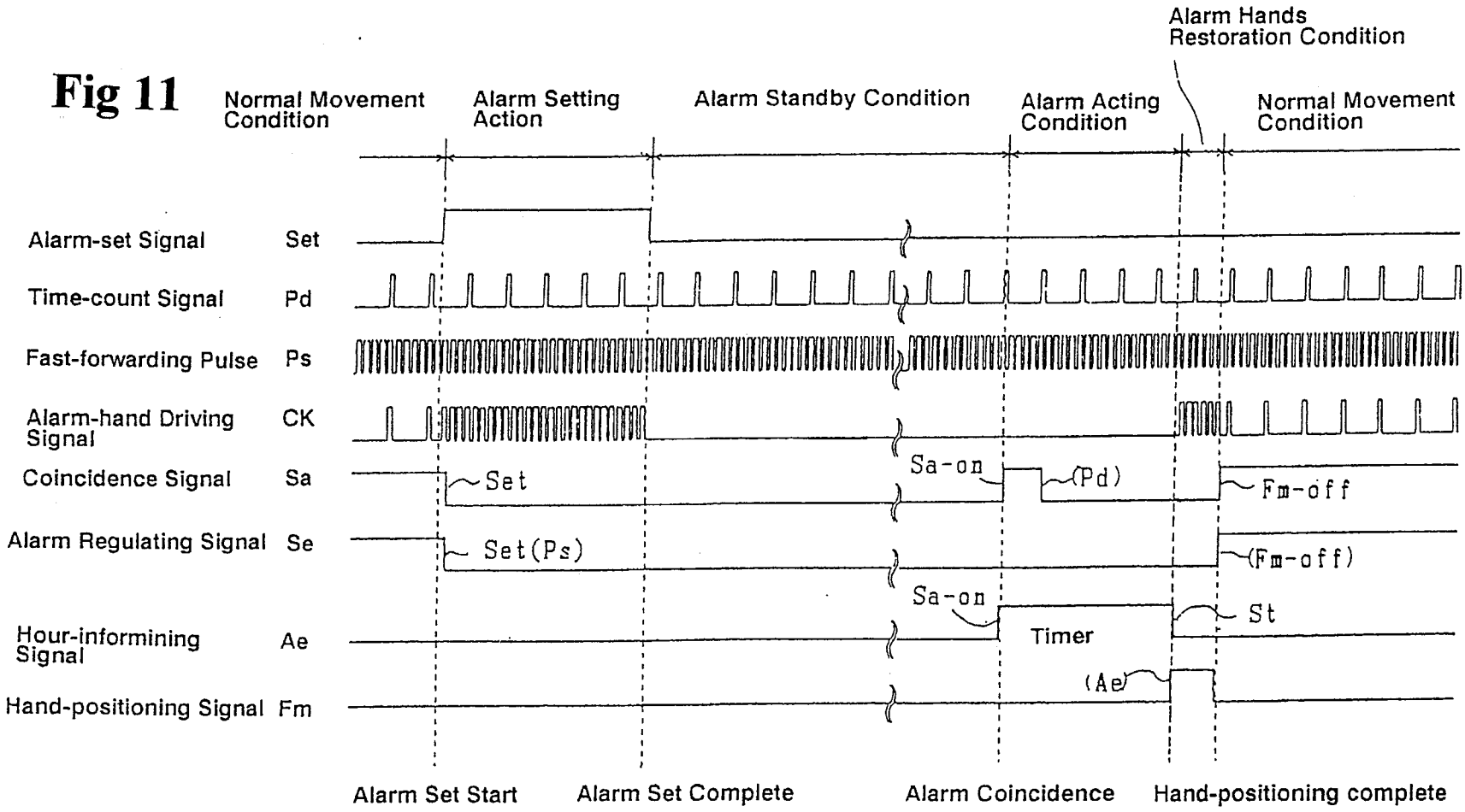
FIG. 11 is a time chart showing wave-form signals in various parts of the electric circuit in FIG. 10.

Specifically, the electric driving circuit employed in this second embodiment is designed such that a hand-positioning control section 211 and an alarm regulating section 212, which are formed of a set-reset flip-flop, are connected in series to the time-signal regulating section 210; an OR gate 231 is provided in the preceding part of the second AND gate 205*b* of the alarm-hand regulating section 205; an AND gate 232 for the reset signal of the alarm regulating section 212 is installed; and an EX-NOR gate 209, in place of the inverter 208 used in the first embodiment, and a coincidence-signal memory section 213 are installed The action of the driving electric circuit of the second embodiment thus constructed is described referring to the time chart given in FIG. 11.

Synchronizing Step

The same procedure as in the first embodiment appiies.

Normal Movement Condition

The same actions as in the first embodiment are taken for synchronizing the time indicating hands 3 with the alarm hands and the time counter 201 with the alarm-hand position counter 202. In this instance, the output Sa from the coincidence detection circuit 207 is retained at "H" condition which consequently brings the output of the EX-NOR gate 209 to "H" condition, and the output Sa from the coincidence-signal memory section 213 also to "H" condition. Both the outputs Ae from the time-signal regulating section 210 and Fm from the hand-positioning control section 211 are retained at "L" condition, and the output Se from the alarm regulating section 212 is retained at "H" condition.

Alarm Setting Action

To set the alarm during the normal movement condition, the setting signal should be kept at "H" by turning the alarm-set switch 204 "ON". By this action, the fast-forwarding pulse signal Ps is passed through the second AND gate of the alarm-hand regulating section 205 and sent to the alarm-hand position counter 202 and the second driving circuit 206 for setting the alarm hands 4 and the contents of the alarm-hand position counter at an alarm-set time (the same procedure as in the first embodiment.)

When the alarm-hand position counter 202 receives said fast-forwarding pulse signal Ps (first pulse), the contents of the time counter 201 and the alarm-hand position counter 202 become inconsistent. This causes the output Sa from the coincidence detection circuit 207 to fall down to "L" (Set condition in FIG. 11). The fast-forwarding pulse signal Ps passed through the second AND gate 205*b* of the alarm-hand regulating section 205 is then transmitted to the alarm regulating section 212 and the coincidence-signal memory section 213 as a reset signal, via the AND gate 232 where the set signal has been put in as "H". This makes the output Se from the alarm regulating section 212 down to "L" condition (Set (Ps) in FIG. 11) and the output Sa from the coincidence-signal memory section 213 to "H" condition.

When the alarm-set switch 204 is turned OFF at the moment the alarm hands 4 reach the target alarm-set time, the set signal falls down to "L" condition (the "alarm-set completed" condition in FIG. 11), thereby preventing the fast-forwarding pulse signal Ps from passing through the second AND gate 205*b*.

In this condition, as stated above, the first AND gate 205*a* of the alarm-hand regulating section 205 prevents the time-counting pulse signal Pd from passing therethrough and stops the signal to be sent to the alarm-hand position counter 202 and the second driving circuit 206, because the output Sa from the coincidence detection circuit 207 and the output Se from the alarm regulating section 212 are retained at "L" condition. Further, under this condition, the output Sa from the coincidence-signal memory section 213 is in "H" condition. The alarm-set action is completed in this manner.

Alarm Standby Condition

The condition is the same as in the first embodiment; the alarm hands 4 are kept at rest at the alarm-set time, and this standstill condition of the alarm hands 4 indicates that the timepiece is in the alarm-set condition. Under this condition, actions of the timepiece are limited to the movement of the time indicating hands 3 and the counting of the pulse signal Pd by the time counter 201.

Alarm Acting Condition

As described above, the time-counting pulse signal Pd is counted by the time counter 201, and when the content of the time counter 201 (current time) eventually coincides with the memorized content of the alarm-hand position counter 202 (alarm-set time), the output Sa from the coincidence detection circuit 207 becomes to "H" condition (Sa-on condition in FIG. 11). By this action, the output Sa from the EX-NOR gate 209 changes to "L" condition, and it works to set the coincidence-signal memory section 213, which, in turn, makes the output Sa to "L" condition to set the time-signal regulating section 210 and makes the output Ae to "[{" condition (Sa-on condition in FIG. 11).

As a result, the time-signal means 220 is activated to sound the time signal for noticing the alarm-set time. After a certain time elapse, the timer signal St is transmitted by the timer installed in the time-signal means 220 to reset the time-signal regulating section 210 and it stops sounding of the time-signal (the same as in the first embodiment.)

(On the other hand, as shown in FIG. 11, the time-counting pulse signal Pd cannot pass the first AND gate 205*a* of the alarm-hand regulating section 205 during the alarm acting condition for sounding the time signal, because the output Se from the alarm regulating section 212 is retained at "L" condition, and, accordingly, the time-counting pulse signal Pd cannot be supplied to the alarm-hand position counter 202 and to the second drive circuit 206 as the alarm-hand driving signal CK. The alarm motor 22, therefore, never rotate while the alarm is in action for sounding the time signal, and thus the droppage the battery voltage can be avoided.

Likewise, the alarm-hand position counter 202 does not work for counting during the alarm is in action. Thus, when the time counter 201 receives the next time-counting pulse signal Pd after the content of the time counter 201 (i.e. current time) has coincided with the memorized content of the alarm-hand position counter 202 (i.e. alarm-set time ) and the output Sa of the coincidence detection circuit 207 has risen to "H" condition, the output Sa of the coincidence detection circuit 207 falls down to "L" condition (condition shown as (Pd) in FIG. 11) because the contents of the time counter 201 and the alarm-hand position counter 202 become inconsistent.

Alarm Hands Restoration and Adjustment Movement

When the time-signal regulating section 210 is reset by the timer signal St after a certain elapse of time, the output Ae from the time-signal regulating section 210 falls down to "L" condition (as shown in FIG. 11) which, in turn, stops the alarm sounding and, at the same time, sets the hand-positioning control section 211 to change the output Fm of the hand-positioning control section 211 to "H" condition (Condition (Ae) in FIG. 11). The output Fm from the hand-positioning control section 211, which is now brought to "H" condition, is transmitted to the second AND gate 205*b* of the alarm-hand regulating section 205 via the OR gate 231.

By these actions, the fast-forwarding signal Ps is sent to the alarm-hand position counter 202 and to the second drive circuit 206 as alarm-hand driving signal CK via the alarm-hand regulating section 205, and subsequently forwards the alarm hands 4, which has been at rest, and the content of the alarm-hand position counter 202. When the content of the alarm-hand position counter 202 (Alarm-set time) coincides with the content of the time counter 201 (Current time), the output Sa from the coincidence detection circuit 207 again becomes to "H" condition (Sa-on condition in FIG. 11) which, in turn, resets the hand positioning section 211 and changes the output Sa from the hand-positioning control section 211 to "L" condition (Fm-off condition in FIG. 11).

As the output Fm from the hand-positioning control section 211 becomes to "L" condition, the alarm hands 4 are brought to stop and the alarm-hand position counter is also brought to stop because the second AND gate 205*b* of the alarm-hand regulating section 205 prevents the passing of the fast-forwarding pulse signal Ps. At the same time, as the output Fm from the hand-positioning control section 211 is changed to "L" condition (Fm-off condition in FIG. 11), the alarm regulating section 212 is set and the output Se becomes to "H" condition ((Fm-off) condition in FIG. 11).

When the output Se from the hand-positioning control section 212 is changed to "H" condition, the first AND gate 205*a* of the alarm-hand regulating section 205 allows passing of the time-counting pulse signal Pd which, in turn, is sent to the alarm-hand position counter 202 and to the second drive circuit 206 as alarm-hand driving signal CK.

Meanwhile, the coincidence signal Sa generated during the alarm hand restoration and adjusting movement is interrupted by the coincidence signal memory section 213 so that said time-signal regulating section 210 cannot be set and consequently makes no needless signal sounding.

The alarm hands 4 and the content of the alarm-hand position counter 202 are thus restored and adjusted, and thereafter the time indicating hands 3 and alarm hands 4 are synchronously driven with the time counter 201 and the alarm-hand position counter 202, and they are brought to the normal movement condition.

As can be seen, the driving circuit of the second embodiment is designed such that the alarm hands 4 are retained standstill while the time-signal means 220 is working to sound, and upon completion of sounding, the alarm hands 4 are forwarded and brought to coincide with the time indicating hands 3, then the unified alarm hands 4 and the time indicating hands 3 are restored together to the normal action for synchronous movement.

As a result, the droppage of battery voltage can be avoided since the alarming action and the alarm hand movement do not take place at the same time, and, accordingly, abnormal movements of the electronic timepiece (erroneous movement of hands for current time) due to the voltage drop can be prevented.

Next, a specific example of the alarm section, which constitutes one of the features of the present invention and is designed to move the alarm hands synchronously with time indicating hands by mechanically linking the alarm hands to a part of the wheel train of the time indicating hands, will be discussed in more detail.

This specific embodiment refers to the second embodiment illustrated in FIG. 2(*a*) and 2(*b*), which comprises the time indicating hands and the alarm hands disposed coaxially.

Figure 12:
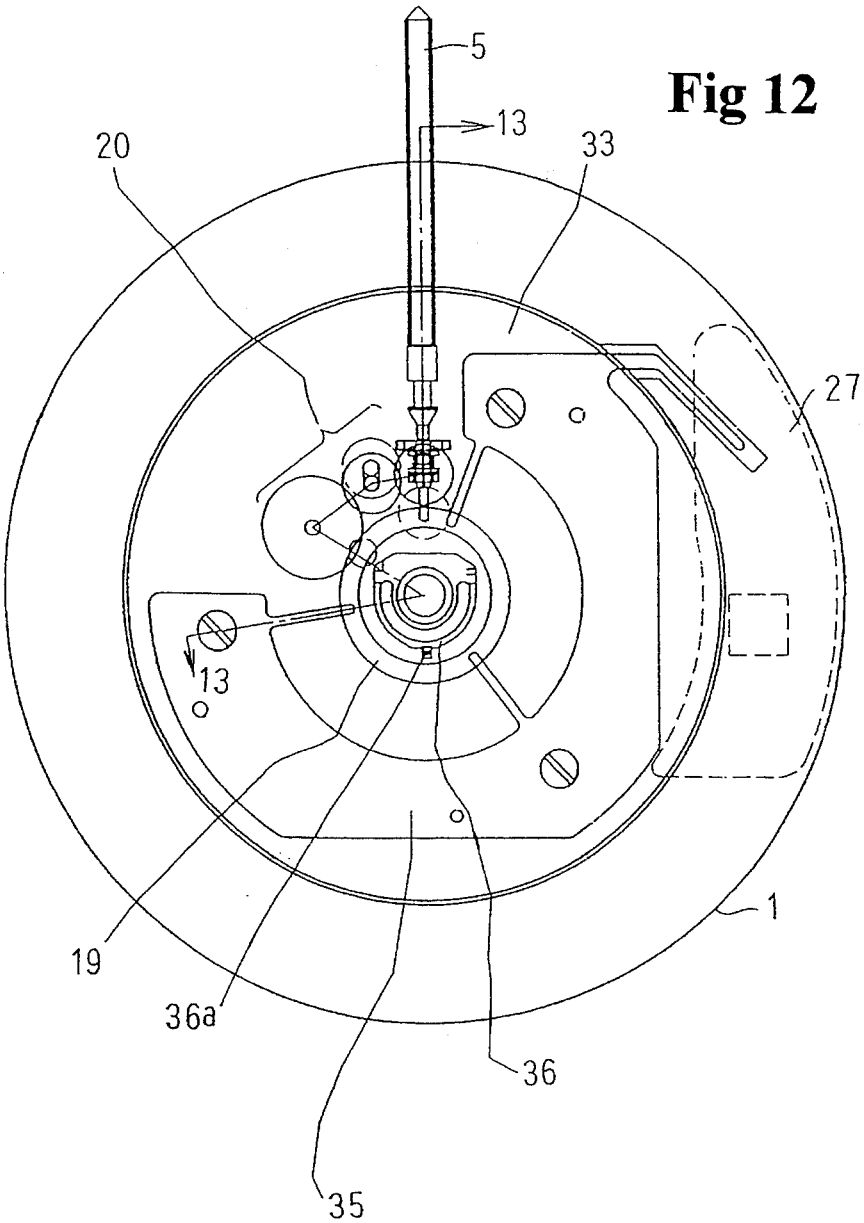
FIG. 12 is a plan view showing a linkage means of the alarm hands and the time indicating hands of the second embodiment presented in FIG. 2.
Figure 15:
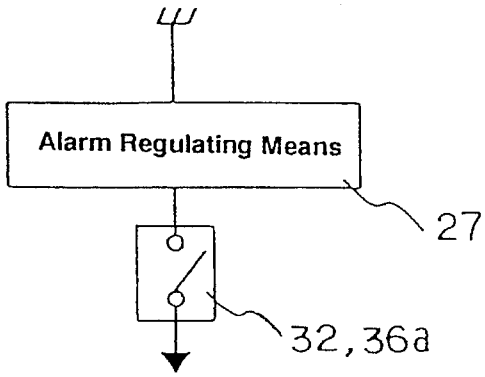
FIG. 15 is a block diagram showing the relationship between the switch and the alarm regulating means of the alarm clock shown in FIG. 12.
Figure 13:
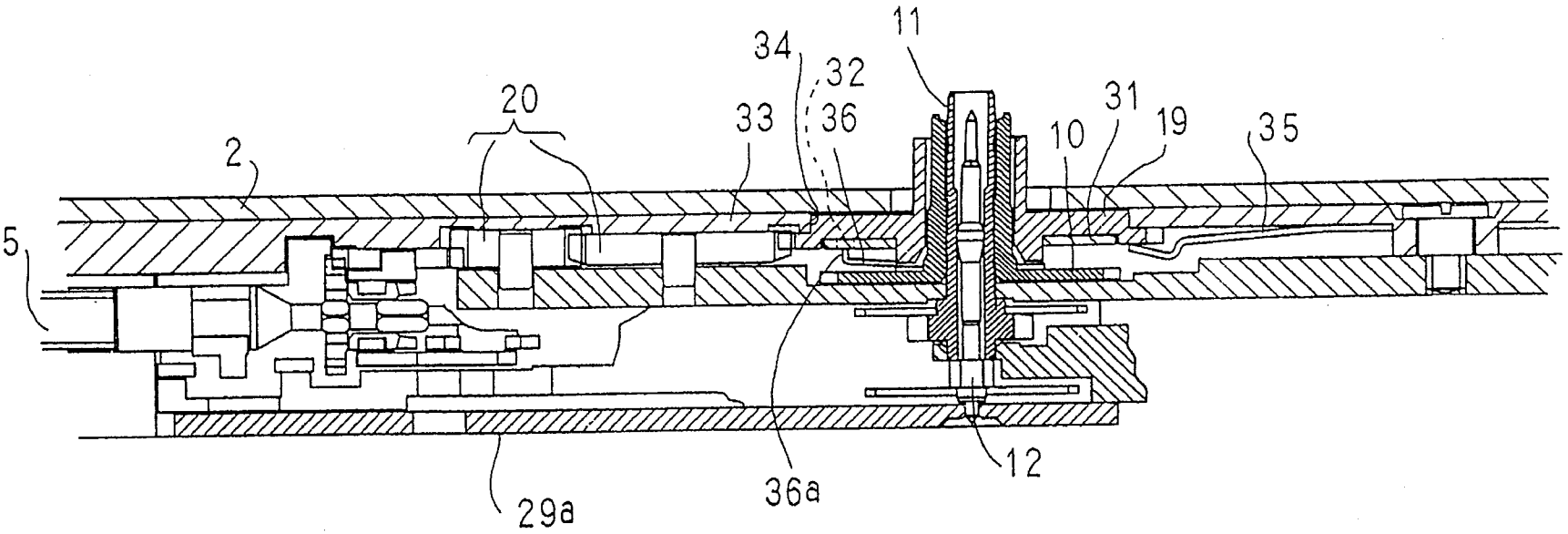
FIG. 13 is a cross-sectional view along the line 13—13 in FIG. 12.
Figure 14A:
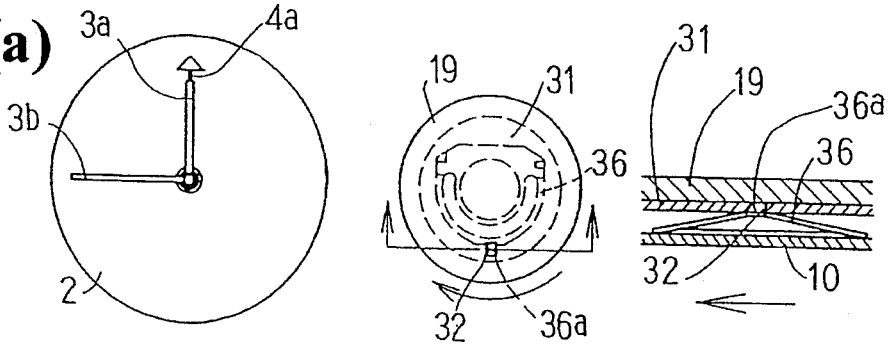
FIGS. 14(*a*) to 14(*d*) are views illustrating the conditions of alarm for the means shown in FIG. 12, and the relationship between the contact spring and the alarm wheel in each condition.
Figure 14B:
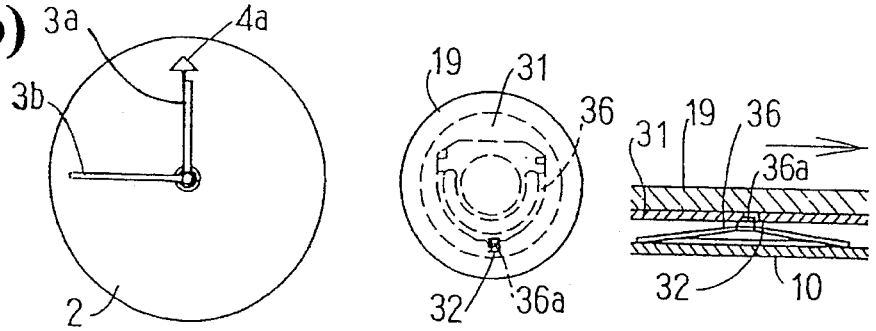
Figure 14C:
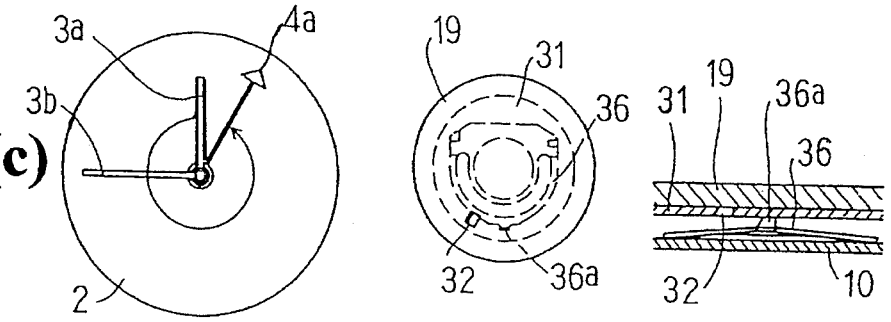
Figure 14D:
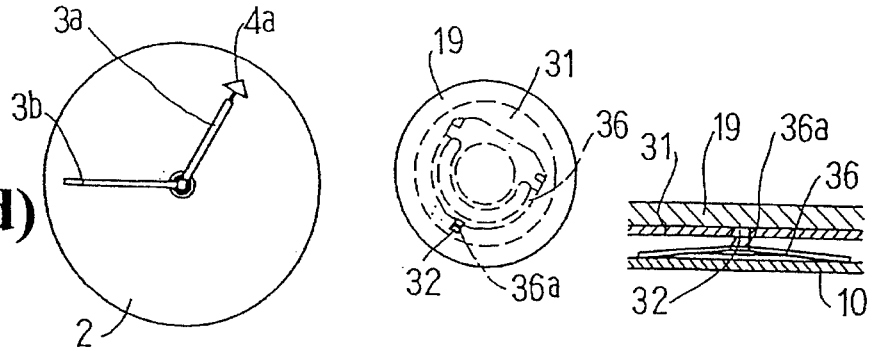

FIG. 12 is a plan view showing the wheel train in the alarm-set section of the alarm clock presented in FIG. 2. FIG. 13 is a cross-sectional view along the line 13—13 in FIG. 12. FIGS. 14(*a*) to 14(*d*) are views illustrating the acting conditions of the alarm clock and the relative positions of the contact spring and the alarm wheel in these conditions. FIG. 15 is a block diagram illustrating the relationship between the switch section and the alarm regulating means.

The alarm clock of the second embodiment comprises the hour hand 3*a*, minute hand 3*b*, second hand 3*c*, and alarm hands 4 for indicating the alarm-set time; all of which are installed coaxially around the center of the dial 2 housed in the case 1.

The alarm wheel 19 supporting the alarm hands 4 is made of a conductive material, and an insulating plate 31 made of a plastic or the like, is attached to the bottom surface of the alarm wheel 19. A contact hole 32 leading to the alarm wheel 19 is provided at an arbitrary position on the insulating plate 31. The alarm wheel 19 is fitted loosely in the hole 34 provided on an alarm-wheel setting plate 33 and its peripheral part is pressed by a leaf spring-shaped alarm-lead plate 35 to prevent it from falling out of the hole 34. Furthermore, the alarm-lead plate 35 is electrically connected to the alarm wheel 19 and to alarm regulating means (the buzzer driving unit 27), as shown in FIG. 12.

On the other hand, a contact spring 36 is attached to the hour wheel 10 on the opposite side facing the insulating plate 31. This contact spring 36 is formed of a half-ring leaf spring, of which the both ends are fixed to the hour wheel 10 and a hook-shaped contact point 36*a* is provided at the apex of that half-ring. The contact point 36*a* of the contact spring 36 is constantly pressed against the insulating plate 31, and forced to jump into the contact hole 32 provided on the insulating plate 31 when the timepiece is in the normal hand movement and when the alarm is in action to bring it to come contact with the alarm wheel 19.

This means that the contact point 36*a* of the contact spring 36 and the contact hole 32 provided on the insulating plate 31 function not only as an alarm switch of the buzzer driving unit 27 (the alarm regulating means) but also as an interlocking means to drive the hour wheel 10 and the alarm wheel 19 together as shown in FIG. 13.

The alarm wheel 19 is linked with the winding stem 5 via the alarm wheel train 20.

Next, the actions of the alarm section, which mechanically links the alarm hands with the time indicating hands to move them in a synchronous motion, are illustrated.

Normal Movement Condition

As shown in FIG. 14(*a*), when the contact point 36*a* of the contact spring 36 is jumped into the contact hole 32 provided on the insulating plate 31, the contact point 36*a* makes the alarm wheel 19 rotate together along with the rotation of the hour wheel 10 by pressing the inner wall of the contact hole 32.

Although the alarm switch is kept "ON" when the contact point 36*a* of the contact spring 36 is held in the contact hole 32, the alarm regulating means 28 is forced to keep the non-alarm condition by the timer circuit installed in the alarm regulating means 28.

Alarm-set Condition

When the alarm wheel 19 is rotated via the winding stem 5 and the alarm wheel train 20 for the purpose of setting alarm time, the contact hole 32 of the insulating plate 31 raises the contact point 36*a* against the pressing power of the contact spring 36 and releases the contact spring from the contact point 32 (See FIG. 14 (*b*)). When the alarm-set is completed as the alarm hands 4 reach the alarm-time set position by the rotation of the alarm wheel 19, the contact point 36*a* of the contact spring 36 is completely released from the contact point 32 and presses the upper surface of the insulating plate 31 (See FIG. 14 (*c*).)

Under the condition shown in FIG. 14 (*c*), the hour wheel 10 rotates and moves the time indicating hands 3. In this condition, the alarm wheel 19 is not rotated along with the rotation of the hour wheel 10 because the pressing power of the contact spring 36 against the insulating plate 31 is smaller than the pressing power of the alarm lead plate 35 against the alarm wheel 19.

Alarm Acting Condition

When the time indicating hands 3 (Current time) and the alarm hands 4 (Alarm-set time) overlap as the hour wheel 10 rotates, the positions of the contact point 36*a* of the contact spring 36 are again brought into agreement with the contact hole 32 (See FIG. 14 (*d*)), and the contact point 36*a* comes to contact with the alarm wheel 19 by jumping into the contact hole 32. The alarm switch is thereby turned "ON" and moves the alarm regulating means 28 to sound the time signal.

As stated, a timer installed in the alarm regulating means 28 works to stop the time signal sounding after a certain period of time, and when the time signal sounding ends the timepiece is brought to aforementioned normal movement condition.

This embodiment, which is designed to ensure the synchronous movement by mechanically linking the alarm hands with the time indicating hands, has a structure that the alarm wheel is formed of a conductive material and the contact hole 32 is formed on the insulating plate 31 attached to said conductive wheel, while the contact spring 36 is attached to the hour wheel 10. However, the parts on which the contact hole 32 is to be formed and the contact spring is attached may not be restricted only to the alarm wheel 19 and the hour wheel 10, but any rotating bodies in the alarm hands driving system or in the time indicating hands driving system can be elected so long as they are disposed facing each other.

Alternatively, it is also possible to choose a time indicating hands driving system for the rotating body which forms the contact hole 32 by attaching the insulating plate 31 and to elect an alarm hands driving system for the rotating body to which the contact spring 36 is attached.

Furthermore, although the contact section (switch part) is designed to act also as the linkage means in the above embodiment, they can be provided separately.

Industrial Applicability

The alarm clock of the present invention is applicable to wristwatches and various timepieces which require an alarm function.

We claim:

1. An alarm clock having time indicating hands, alarm hands disposed coaxially with the time indicating hands, and alarm setting means, wherein the alarm setting means is provided with an alarm section which stops movement of the alarm hands when said alarm setting means is in an alarm-set condition, and moves the alarm hands in a synchronous motion with the time indicating hands when said alarm setting means is in a non-alarm-set condition.

2. The alarm clock according to claim 1, which is provided a motor for moving the time indicating hands and a motor for moving the alarm hands separately.

3. The alarm clock according to claim 2, wherein the alarm section is provided with a time counter which counts time-counting pulse signal for moving the time indicating hands; an alarm-hand position counter which counts the time-counting pulse signal for moving the alarm hands; a coincidence detection circuit which compares contents of said two counters; and an alarm-hand regulating section which stops the alarm motor when comparison result by said coincidence detection circuit is inconsistent.

4. The alarm clock according to claim 3, wherein the alarm hand regulating section works to stop counting of the alarm hand position counter when the comparison result by the coincidence detection circuit is inconsistent.

5. The alarm clock according to claim 3, wherein the alarm hand regulating section works to move again the alarm motor and the alarm hand position counter when the comparison result by the coincidence detection circuit is consistent.

6. The alarm clock according to claim 3, wherein said alarm clock is provided with time signaling means for a specified period of time when the comparison result by the coincidence detection circuit is consistent, and a hand position regulating section which activates the alarm motor for moving the alarm hands by receiving a stop signal from the time signaling means.

7. The alarm clock according to claim 6, wherein said alarm clock is provided with an alarm regulating section which works to forward the alarm hands to the current time after cease of time signaling of the time signaling means and works to resume normal movement of the alarm hands after said alarm hands reach current time by transmitting the fast-forwarding pulse signal to the alarm hand position counter in compliance with a signal from the hand positioning regulating section and by transmitting the time-counting pulse signal to the alarm hand position counter in compliance with a signal from the alarm regulating section.

8. The alarm clock according to claim 1, further comprising an alarm hands driving system having a rotating body with a contact point, a time indicating hands driving system having a rotating body with a contact point both rotating bodies facing each other, and an alarm regulating section which activates the time signaling means for a specified period of time when said contact points are brought to contact.

9. The alarm clock according to claim 1, further comprising an alarm hands driving system having a rotating body with a contact point and a time indicating hands driving system having a rotating body with a contact point, both rotating bodies facing each other, and linkage means to move the rotating body in the time indicating hands driving system and the rotating body in the alarm hands driving system together when said contact points are brought to come into contact.

10. The alarm clock according to claim 9, wherein said contact points are designed to serve also as said linkage means.

11. The alarm clock according to claim 10, wherein said linkage means has a concave formed in an alarm wheel of the time indicating hands driving system and a spring fixture formed in a hour wheel of the alarm hands driving system.

12. The alarm clock according to claim 11, wherein the concave and the spring fixture constitutes the contact points.

* * * * *